US008122562B2

(12) United States Patent
Krebs

(10) Patent No.: US 8,122,562 B2
(45) Date of Patent: Feb. 28, 2012

(54) SURFACE CLEANING IMPLEMENT WITH INDEPENDENT SUCTION NOZZLE AND AGITATOR

(75) Inventor: Alan J. Krebs, Pierson, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 239 days.

(21) Appl. No.: 12/340,037

(22) Filed: Dec. 19, 2008

(65) Prior Publication Data

US 2009/0094786 A1 Apr. 16, 2009

Related U.S. Application Data

(63) Continuation of application No. 12/041,007, filed on Mar. 3, 2008.

(60) Provisional application No. 60/893,033, filed on Mar. 5, 2007.

(51) Int. Cl.
*A47L 7/00* (2006.01)
*A47L 5/24* (2006.01)

(52) U.S. Cl. ..... 15/320; 15/321; 15/344; 15/365; 15/373; 15/398; 15/399; 15/415.1

(58) Field of Classification Search ..... 15/320–322, 15/344, 365, 383, 392, 415.1, 373, 398, 399; *A47L 7/00, 5/24*

See application file for complete search history.

(56) References Cited

U.S. PATENT DOCUMENTS

| | | | | |
|---|---|---|---|---|
| 4,179,769 | A | 12/1979 | Lundquist | |
| 4,893,375 | A * | 1/1990 | Girman et al. | 15/321 |
| 5,263,224 | A | 11/1993 | Lovelady | |
| 5,377,383 | A | 1/1995 | Christensen | |
| 5,625,920 | A * | 5/1997 | Bores et al. | 15/322 |
| 5,634,238 | A | 6/1997 | McCaffrey et al. | |
| 5,839,154 | A | 11/1998 | Kawai et al. | |
| 5,974,624 | A | 11/1999 | Eisen | |
| 5,983,442 | A * | 11/1999 | Louis et al. | 15/320 |
| 6,021,545 | A | 2/2000 | Delgado et al. | |
| 6,324,723 | B1 | 12/2001 | Dodson et al. | |
| 6,421,874 | B1 * | 7/2002 | McCormick | 15/364 |
| 6,517,596 | B2 | 2/2003 | Dodson et al. | |
| 6,687,952 | B1 | 2/2004 | Mohan, Jr. | |
| 2002/0092117 | A1 | 7/2002 | Kasper et al. | |
| 2003/0051309 | A1 * | 3/2003 | Morgan et al. | 15/373 |
| 2005/0125921 | A1 | 6/2005 | Leonard | |
| 2006/0260089 | A1 | 11/2006 | Hammond | |

FOREIGN PATENT DOCUMENTS

| | | |
|---|---|---|
| GB | 1190219 | 11/1967 |
| WO | 9212664 A1 | 8/1992 |
| WO | 2008078238 A1 | 7/2008 |

* cited by examiner

*Primary Examiner* — David Redding
(74) *Attorney, Agent, or Firm* — McGarry Bair PC

(57) ABSTRACT

An surface cleaning implement comprises a recovery tank and a suction nozzle in fluid communication with a recovery tank, a fan/turbine assembly including a turbine-driven suction fan for generating suction at the suction nozzle, which draws liquid and air into and through the accessory tool. A fluid dispensing assembly is disclosed for storing and distributing fluid to the surface to the cleaned. An agitator assembly can be moved from a use to a non-use orientation to alternately scrub the surface to the cleaned and to extract fluid from the surface to be cleaned.

19 Claims, 17 Drawing Sheets

SURFACE CLEANING IMPLEMENT WITH INDEPENDENT SUCTION NOZZLE AND AGITATOR

CROSS-REFERENCE TO RELATED APPLICATION

This application is a continuation of U.S. Ser. No. 12/041,007, filed Mar. 3, 2008, which is related to U.S. Provisional Patent Application No. 60/893,033, filed Mar. 5, 2007, all of which are incorporated herein by reference in their entirety.

BACKGROUND OF THE INVENTION

1. Field of the Invention

This invention relates to surface cleaning implement for a vacuum cleaner. In one of its aspects, the invention relates to a surface cleaning implement that has a suction nozzle and an agitator that are configured to function independently of each other.

2. Description of the Related Art

Vacuum cleaning appliances are known for removing dry or wet debris from surfaces, including fabric-covered surfaces like carpets and upholstery, and bare surfaces like hardwood, linoleum and tile. Conventional dry vacuum cleaners are not capable of distributing or recovering fluids from surfaces because moisture can damage the motor and filtration system of the vacuum cleaner. As a result, liquid extraction vacuum cleaning appliances such as vacuum mops, extractors and carpet cleaners must be used to distribute and/or remove liquids from surfaces requiring a consumer to keep several large pieces of equipment available to complete different floor cleaning needs.

Various attachments have been developed to adapt conventional dry vacuum cleaners to distribute and recover liquids. Many of these attachments only allow for fluid recovery, and are not provided with means for fluid distribution. Some attachments include replacement filter systems that can collect recovered fluid. Other attachments include hand-held accessory tools, often referred to as wet or wet pick-up tools, that are coupled to the conventional dry vacuum cleaner using a vacuum hose.

A noted problem with using a wet pick-up tool to convert a conventional dry vacuum cleaner into one capable of fluid distribution and/or recovery is preventing fluid from entering the filtration system and suction source of the vacuum cleaner. Accordingly, wet pick-up tools often include means for separating working air from recovered fluid and a container for collecting the recoverd fluid so that fluid is prevented from passing, along with the working air, to the conventional dry vacuum cleaner through the vacuum hose. However, if the container is overfilled or turned to an unusual angle, known wet pick-up tools can allow fluid to remain in the working air and enter the conventional dry vacuum cleaner, causing damage to the filtration system and suction source.

SUMMARY OF THE INVENTION

According to the invention, a surface cleaning implement comprises a housing having a suction nozzle adapted to be connected to a source of suction, an agitator assembly mounted to the housing and configured so that the agitator is in contact with a surface to be cleaned and the suction nozzle is spaced from the surface to be cleaned in a first position, and the suction nozzle is in contact with the surface to be cleaned and the agitator is spaced from the surface to be cleaned in a second position.

In one embodiment, at least one of the suction nozzle and agitator is rotatably mounted to the housing for movement between the first and second positions.

In one embodiment, the agitator assembly is movably mounted in a pair of agitator retainers formed on opposite sides of the housing for movement between the first and second positions. The agitator assembly can be an elongated agitator body that has at least one row of bristles extending along the body for scrubbing or otherwise agitating the surface to be cleaned.

In one embodiment, a locking projection or detent is formed on one of the agitator body and the agitator retainers and a pair of spaced locking slots is formed in the other of the agitator body and agitator retainers for alternately receiving the projection or detent to releasably retain the agitator assembly in the first and second positions. The spaced locking slots can be spaced about 90° apart.

In one embodiment, a recovery tank is mounted on the housing and in fluid communication with the suction nozzle. A turbine can be rotatably mounted within a turbine chamber having an inlet opening in fluid communication with the atmosphere and an outlet opening connected to a suction opening in the housing for rotatably driving the turbine with suction from a suction source. Further, a suction fan can be rotatably mounted within a suction fan chamber having an inlet opening in fluid communication with the suction nozzle through the recovery tank for depositing fluid that is drawn in through the suction nozzle into the recovery tank and an outlet opening in fluid communication with the atmosphere. Still further, a coupling can be provided between the turbine and the suction fan so that the turbine drives the suction fan when suction is applied at the suction opening. In addition, a fluid dispensing assembly can be mounted to the housing for distributing cleaning fluid onto the surface to be cleaned. The recovery tank can include an air/liquid separator for separating air from liquid drawn into the recovery tank through the suction nozzle.

DESCRIPTION OF THE PREFERRED EMBODIMENT

Figure 1:
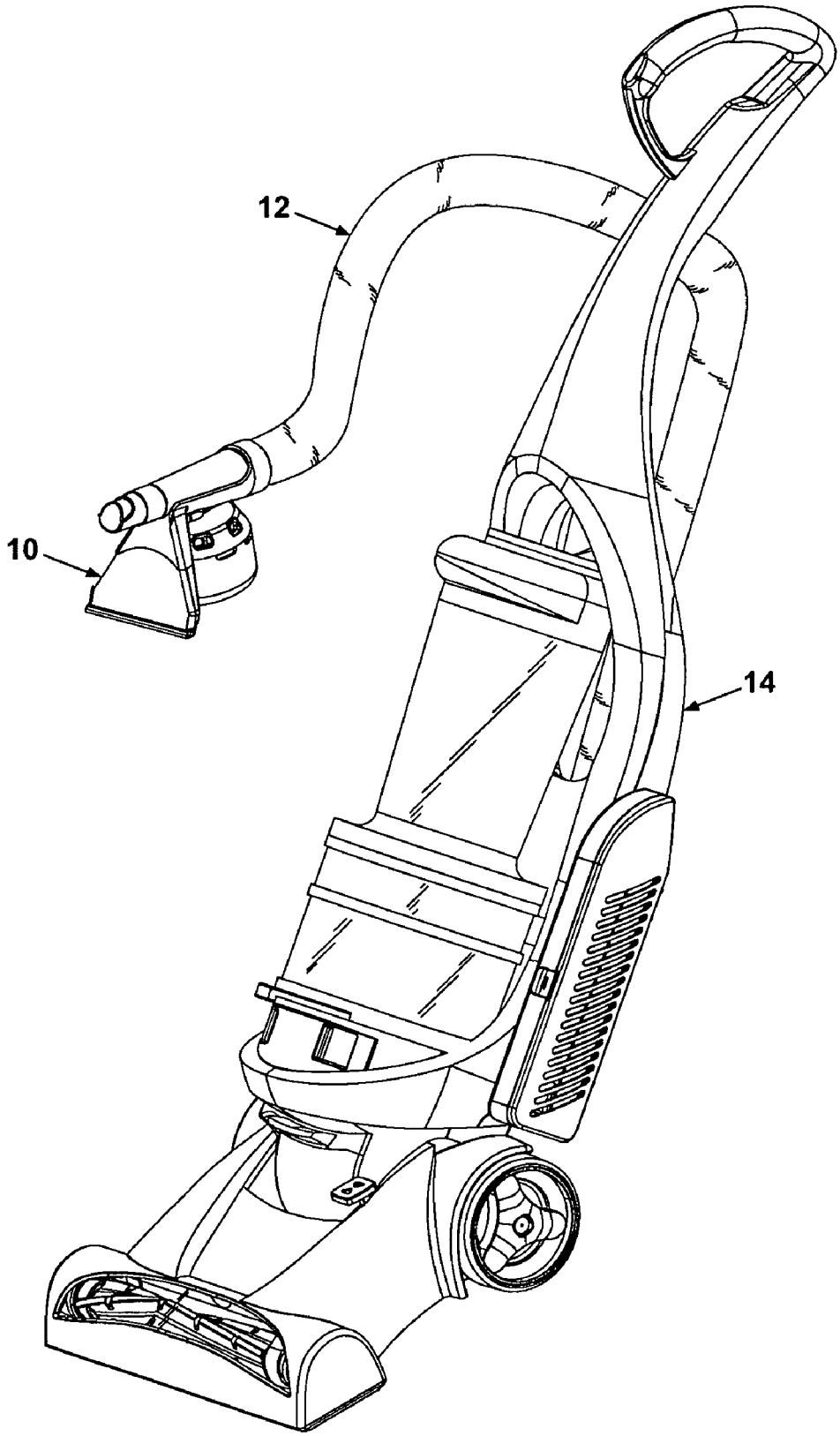
FIG. 1 is a perspective view of a first embodiment of an accessory tool according to the present invention connected to a vacuum hose that is coupled with a conventional dry vacuum cleaning appliance.

Referring to the drawings, and in particular to FIG. 1, a first embodiment of an accessory tool 10 according to the present invention is illustrated that comprises a fluid delivery system for storing cleaning fluid and delivering the cleaning fluid to a surface to the cleaned, and a fluid recovery system for removing the spent cleaning fluid and dirt from the surface to the cleaned and storing the spent cleaning fluid and dirt. The accessory tool 10 is configured for removable mounting to a vacuum hose 12, which is in turn coupled with a source of suction. Preferably, the source of suction is a conventional dry vacuum cleaner 14; however any commonly known vacuum cleaning appliance comprising a suction source and vacuum hose is acceptable. As used herein, the term "dry vacuum cleaner" is used to denote a floor surface cleaner that is not capable of fluid distribution or fluid recovery without the accessory tool 10, unless it is specifically stated otherwise. Furthermore, the accessory tool 10 can be utilized with other vacuum cleaning appliances, such as a wet carpet cleaner or liquid extractor.

The vacuum cleaner 14 can comprise any type of vacuum cleaner utilizing a vacuum hose, such as an upright, canister, stick-type, or hand-held vacuum cleaner, or with a built-in central vacuum cleaning system. Further, the vacuum cleaner 14 can be used to clean fabric-covered surfaces, such as carpets and upholstery, or bare surfaces, such as hardwood, linoleum, and tile. The vacuum cleaner 14 draws in dirt-laden air through the hose 12 and into a filtration system where the dirt is trapped for later disposal. Exemplary filtration systems can include a filter bag or a bagless cyclonic filter. As illustrated, the vacuum cleaner 14 comprises an upright vacuum cleaner using at least a cyclone separator as the filtration system. Details of a suitable vacuum cleaner for use with the accessory tool 10 are disclosed in commonly assigned U.S. Pat. No. 6,810,557 to Hansen et al.

Figure 2:
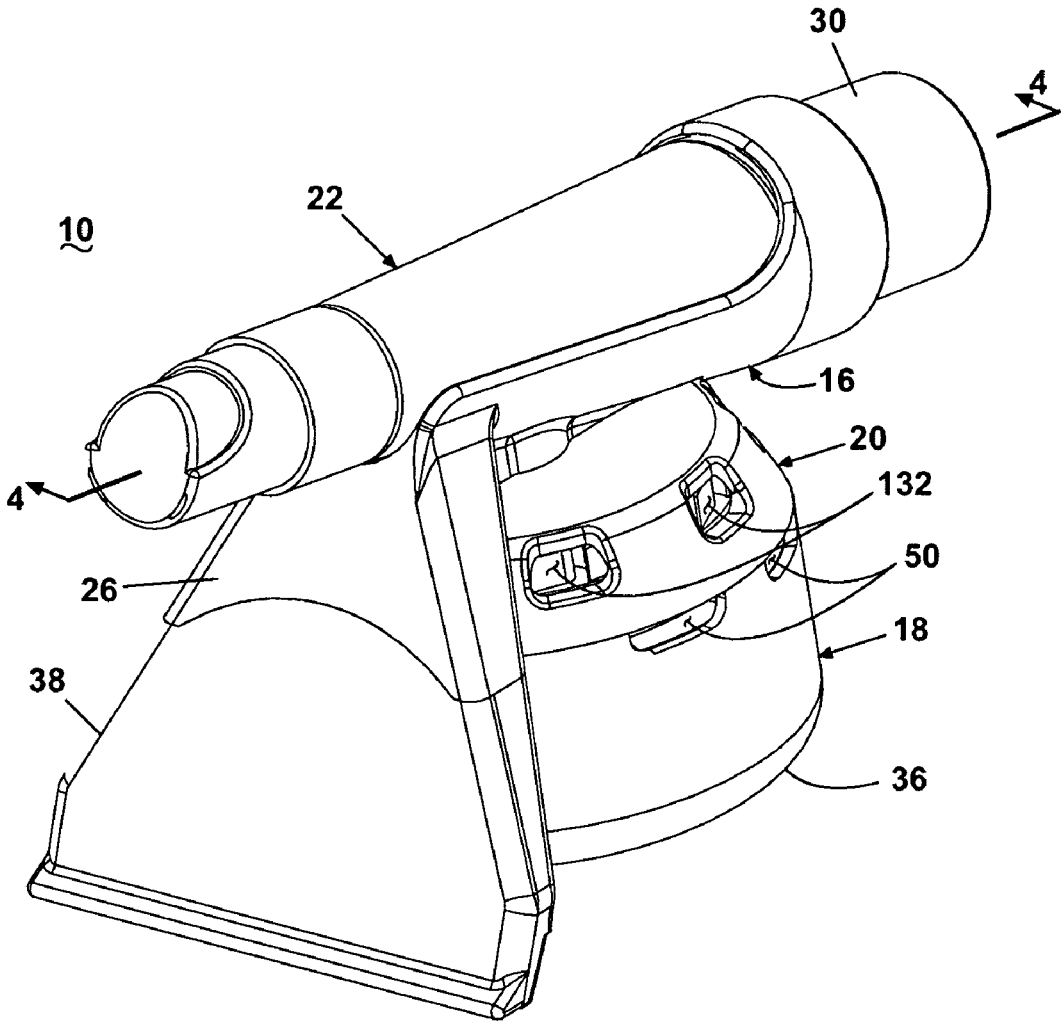
FIG. 2 is a perspective view of the accessory tool, showing a tool body supporting a recovery tank assembly and a fan/turbine assembly at a lower portion thereof and a fluid dispensing system at an upper portion thereof.
Figure 3:
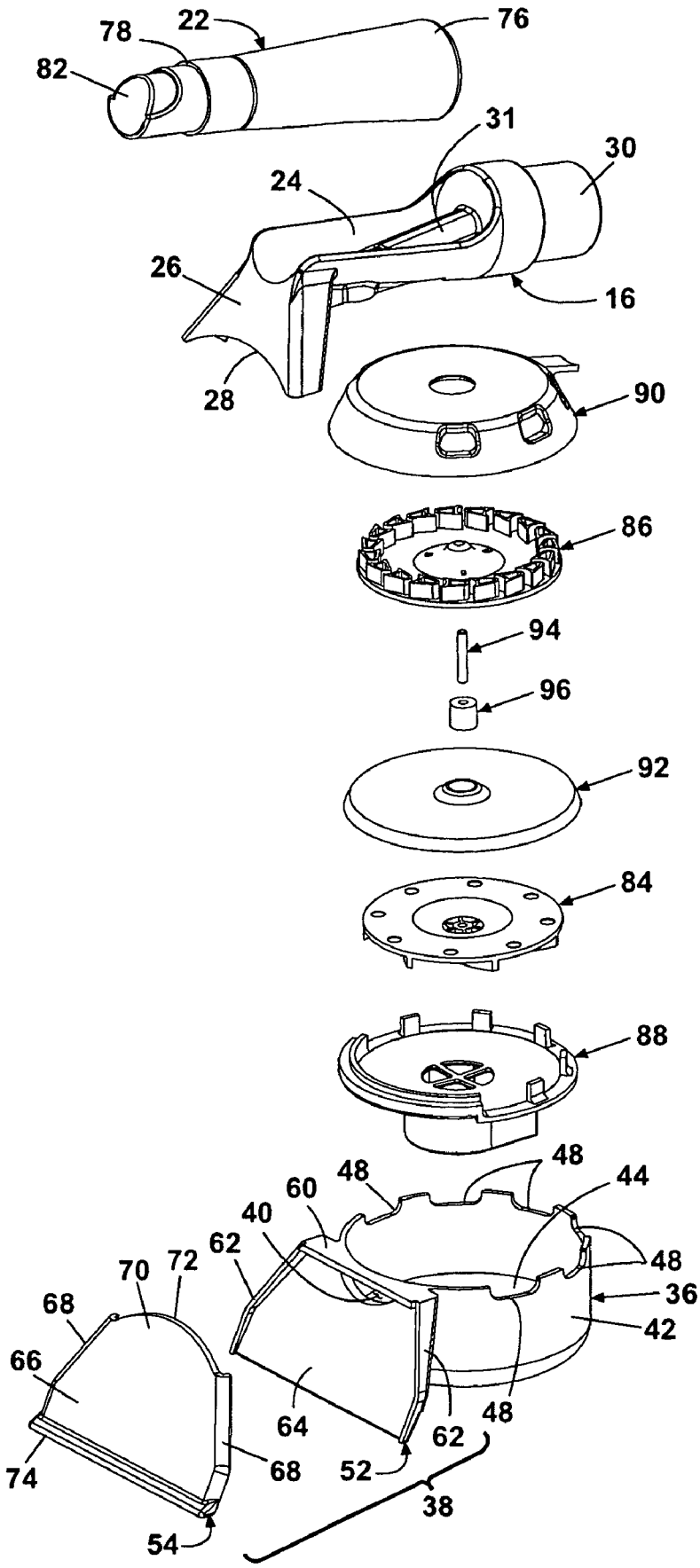
FIG. 3 is an exploded view of the accessory tool from FIG. 2.
Figure 4:
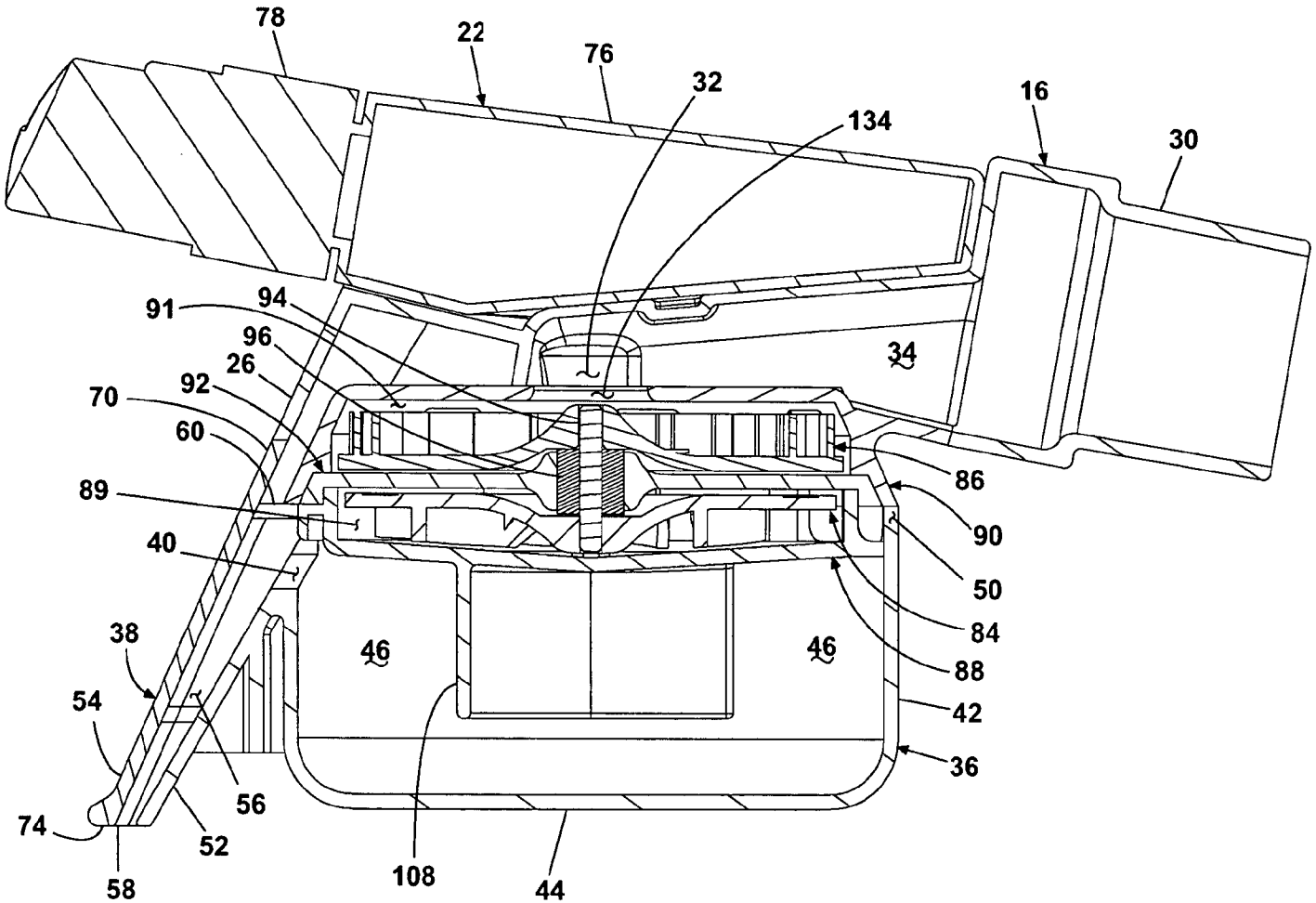
FIG. 4 is a sectional view taken through line 4-4 of FIG. 2.

Referring to FIGS. 2-4, the accessory tool 10 comprises a tool body 16 that removably supports a recovery tank assembly 18 and a fan/turbine assembly 20 at a lower portion thereof, lower being defined as relative to the typical use position of the accessory tool 10, and a fluid dispensing assembly 22 at an upper portion thereof. The recovery tank assembly 18 stores recovered cleaning fluid and dirt, while the fluid dispensing assembly 22 stores cleaning fluid before it is distributed to the surface to be cleaned. The recovery tank assembly 18 can further comprise an air/liquid separator from separating air from recovered cleaning fluid and dirt. The cleaning fluid can comprise any suitable cleaning fluid, including, but not limited to, water, concentrated detergent, diluted detergent, and the like. The fan/turbine assembly 20 is generally positioned between the tool body 16 and the recovery tank assembly 18 and is used generate fluid and air flow through the accessory tool 10.

Figure 5A:
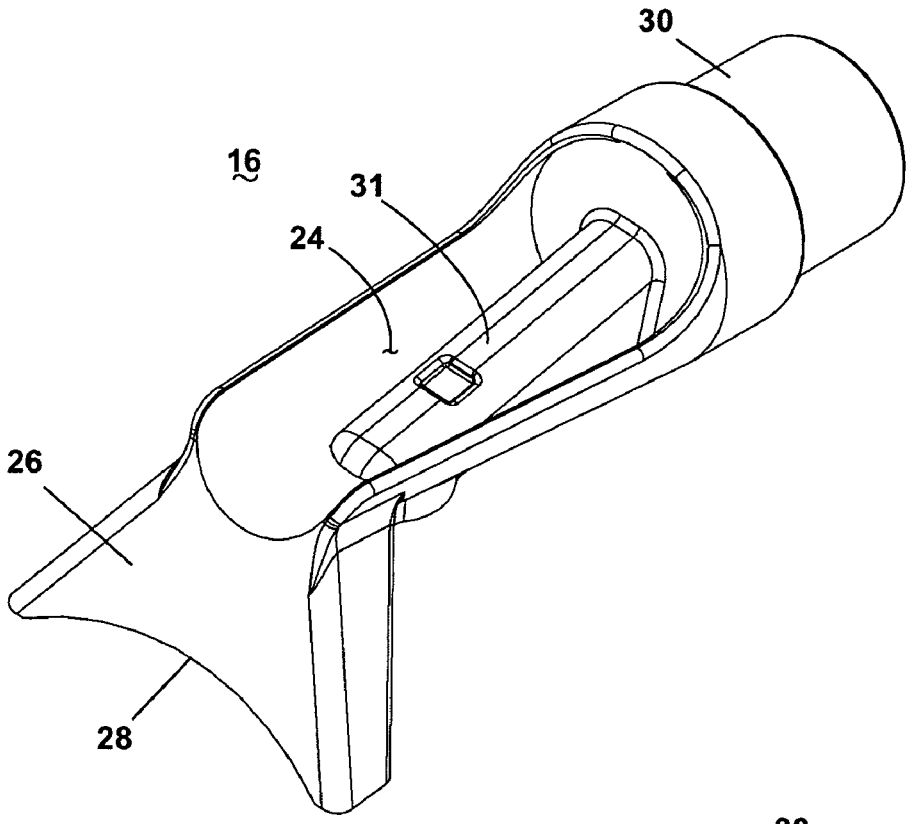
FIG. 5A is a top perspective view of the tool body from FIG. 2.
Figure 5B:
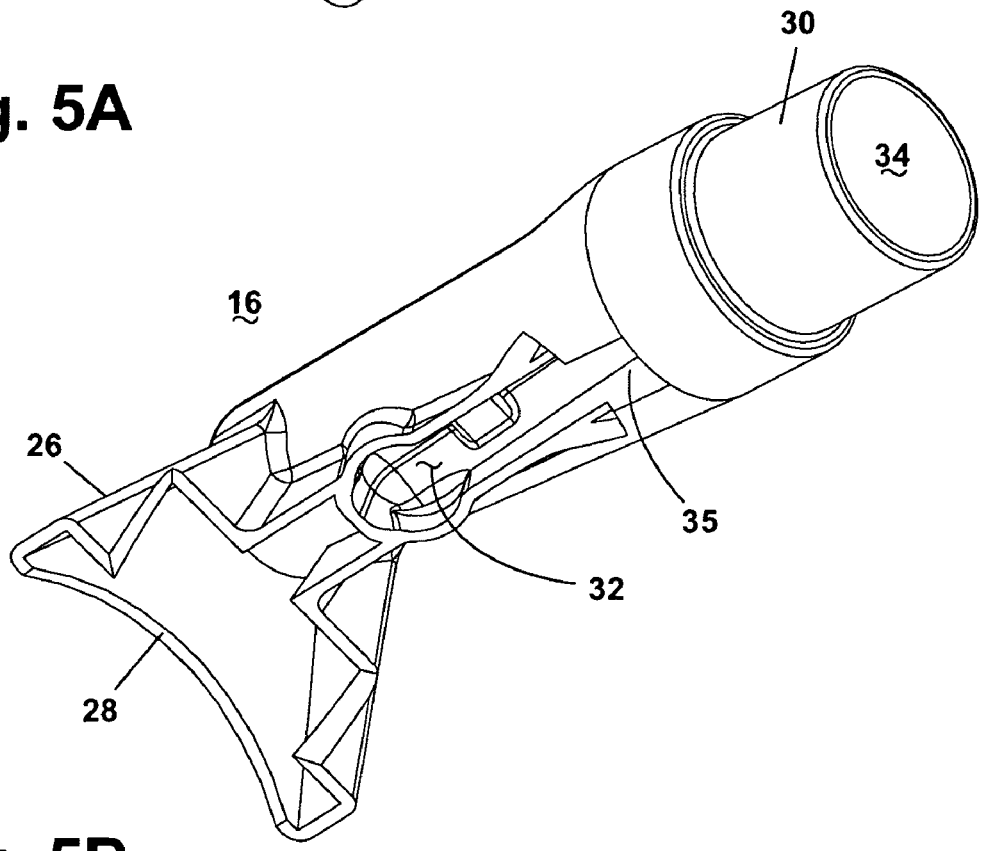
FIG. 5B is a bottom perspective view of the tool body from FIG. 2.

Referring to FIGS. 3, 5A, and 5B, the tool body 16 comprises a fluid dispensing assembly receiver 24 that removably mounts the fluid dispensing assembly 22 positioned on an upper portion of the tool body 16, a nozzle receiver 26 having an arcuate lower surface 28 positioned at a forward end of the tool body 16, and a hollow hose connector 30 positioned at a rear end of the tool body 16, opposite the nozzle receiver 26. The fluid dispensing assembly receiver 24 at least partially receives the fluid dispensing assembly 22 and can comprise a retaining feature, such as a ridge 31 that retains a portion of the fluid dispensing assembly 22 within the fluid dispensing assembly receiver 24. The hose connector 30 is configured to fluidly couple with the vacuum hose 12, or another accessory tool (not shown), such as an extension pipe coupled with the vacuum hose 12. Furthermore, the hose connector 30 provides a convenient place for the user to grip the accessory tool 10. A working air conduit inlet opening 32 is formed on a lower surface of the tool body 16, opposite the fluid dispensing assembly receiver 24 and is in fluid communication with the fan/turbine assembly 20. A working air conduit 34 is formed through the tool body 16 and extends between the working air conduit inlet opening 32 and the hose connector 30. Thus, the working air conduit 34 fluidly communicates with a source of suction, such as the vacuum cleaner 14, via the vacuum hose 12, or another accessory tool. A turbine cover tab receiver 35 is formed on a lower surface of the tool body 16, between the working air conduit inlet opening 32 and the hose connector 30 and is configured to receive a portion of the fan/turbine assembly 20, as will be presently described.

Referring to FIGS. 3 and 4, the recovery tank assembly 18 comprises a recovery tank 36 and a suction nozzle 38 in communication with the recovery tank 36 via a recovery tank inlet 40. The recovery tank 36 comprises a generally cylindrical peripheral wall 42 having a closed bottom 44 and forms a recovery chamber 46 in which recovered cleaning fluid and dirt passing through the suction nozzle 38 is received via the recovery tank inlet 40. Multiple recesses 48 are formed in the upper edge of the peripheral wall 42 and form exhaust outlets 50 when the recovery tank 34 is mounted to the fan/turbine assembly 20. Preferably, one or both of the recovery tank 36 and the suction nozzle 38 are translucent or transparent to allow the contents to be at least partially visible to the user.

The recovery tank 36 is removably mounted to the fan/turbine assembly 20 and can be removed therefrom to empty the contents of the recovery chamber 46 after a cleaning operation is complete.

The suction nozzle 38 comprises a rear nozzle body 52, which, as illustrated, is integrally formed with the recovery tank 36 and a front nozzle body 54 removably mounted to the rear nozzle body 52 to form a fluid flow path 56 therebetween. In another embodiment (not illustrated), the front nozzle body 54 is not removable from the rear nozzle body 52. In yet another embodiment (not illustrated), the recovery tank 36 is removable from the suction nozzle 38. The fluid flow path 56 extends between a suction nozzle opening 58, which, in operation, is positioned adjacent the surface to be cleaned, and the recovery tank inlet 40.

The rear nozzle body 52 comprises a generally planar upper wall 60 and two spaced side walls 62 joined to a rear wall 64. The front nozzle body 54 comprises a front wall 66 having two spaced side walls 68 configured to snap-fit to the side walls 62 of the rear nozzle body 52 to releasably secure the front nozzle body 54 to the rear nozzle body 52. The front wall 66 further comprises an upper portion 70 that extends above the side walls 68 and comprises an arcuate upper surface 72. When the front nozzle body 54 is mounted to the rear nozzle body 52, the upper portion 70 extends above the upper wall 60 of the rear nozzle body 54 and the arcuate upper surface 72 conforms to the arcuate lower surface 28 of the nozzle receiver 26. The upper portion 70 further forms an area where the user can grip the front nozzle body 54 to remove it from the rear nozzle body 52. The front wall 66 further has a generally flat glide surface 74 at a lower portion thereof, adjacent the suction nozzle opening 58, which rests on the surface to be cleaned during operation and helps distribute the weight of the accessory tool 10 over a relatively large surface area so that the user may glide the accessory tool 10 over the surface to be cleaned with less exertion.

Figure 6:
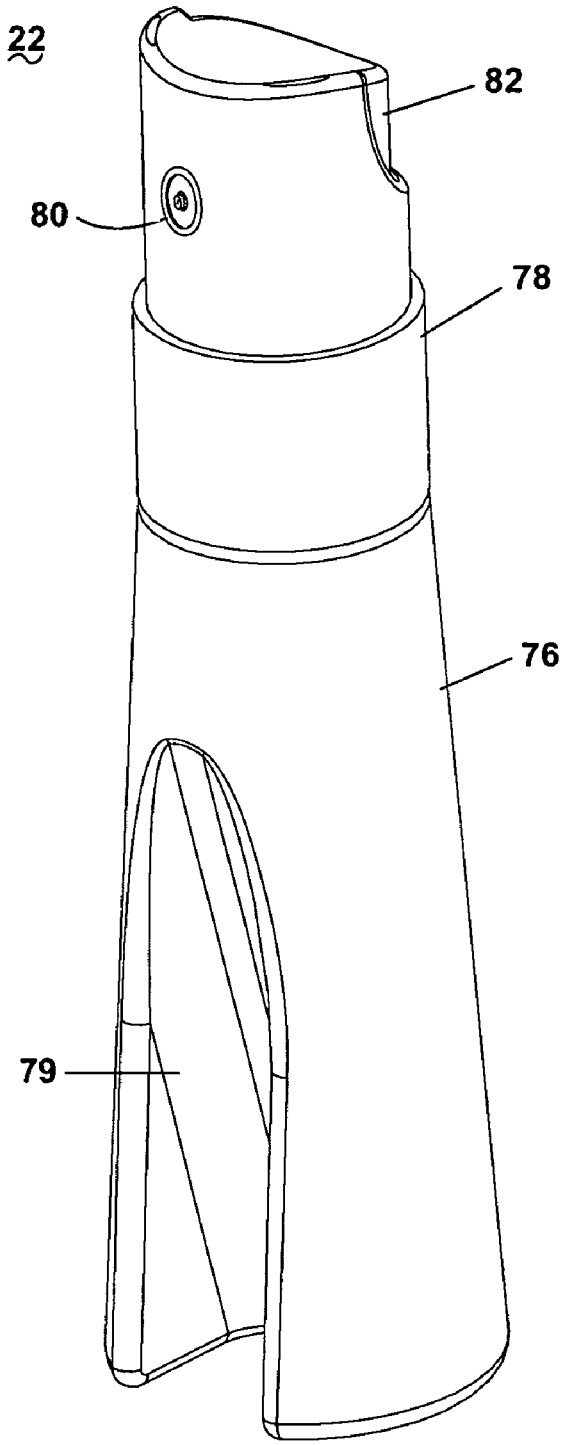
FIG. 6 is a perspective view of the fluid dispensing assembly from FIG. 2.

Referring to FIG. 6, the fluid dispensing assembly 22 can comprise any vessel that can store and distribute the cleaning fluid. As illustrated, the fluid dispensing assembly 22 comprises a cleaning fluid container 76 for storing the cleaning fluid and a manually actuable dispensing cap 78 mounted to the cleaning fluid container 76. The cleaning fluid container 76 is preferably shaped to complement the shape of the fluid dispensing assembly receiver 24, and can comprise a recessed portion 79 that can be press-fit over the ridge 31 of the fluid dispensing assembly receiver 24 to mount the fluid dispensing assembly 22 to the tool body 16. The dispensing cap 78 comprises a spray nozzle 80 for distributing cleaning fluid onto the surface of the cleaned and a conventional pump (not shown) used in non-aerosol dispensers that is operated by a movable discharge button 82. In operation, the user depresses the discharge button 82 to distribute a dose of cleaning fluid from the spray nozzle 80 onto the surface to be cleaned. The user may repeatedly depress the discharge button 82 to distribute multiple doses until a desired amount of cleaning fluid has been applied to onto the surface to be cleaned. When empty, the fluid dispensing assembly 22 can be removed, discarded and replaced with a new fluid dispensing assembly, or the fluid dispensing assembly 22 can be refilled with cleaning fluid and reused. It is understood that in some cleaning operations, the user may desire to only recover fluid from the surface to be cleaned, and in this case, cleaning fluid is not dispensed from the fluid dispensing assembly 22.

Referring to FIGS. 3 and 4, the fan/turbine assembly 20 comprises a suction fan 84 in fluid communication with the suction nozzle 38 to create suction force to draw cleaning fluid and dirt from the surface to be cleaned into the recovery tank 36, and a turbine 86 coupled to the suction fan 86 to drive the suction fan 86 using working air drawn over and through the turbine by the vacuum cleaner 14. The fan/turbine assembly 20 further comprises a suction fan cover 88, a turbine cover 90, and a separation plate 92. Together, the suction fan cover 88 and the separation plate 92 define a suction fan chamber 89 in which the suction fan 84 is received. Similarly, the turbine cover 90 and the separation plate 92 define a turbine chamber 91, which is separate from the suction fan chamber 89, in which the turbine 86 is received. The suction fan cover 88 is in turn at least partially received by the recovery tank 36 and the turbine cover 90 is mounted to the lower surface of the tool body 16 and rests upon the recovery tank 36. The suction fan 84 and the turbine 86 are rotatably mounted to the separation plate 92 by a coupling, which is illustrated herein as an axle 94 retained within a bearing 96 mounted to the separation plate 92. The axle 94 comprises two ends that pass through the bearing 96, each of which respectively mounts one of the suction fan 84 and the turbine 86.

Figure 7A:
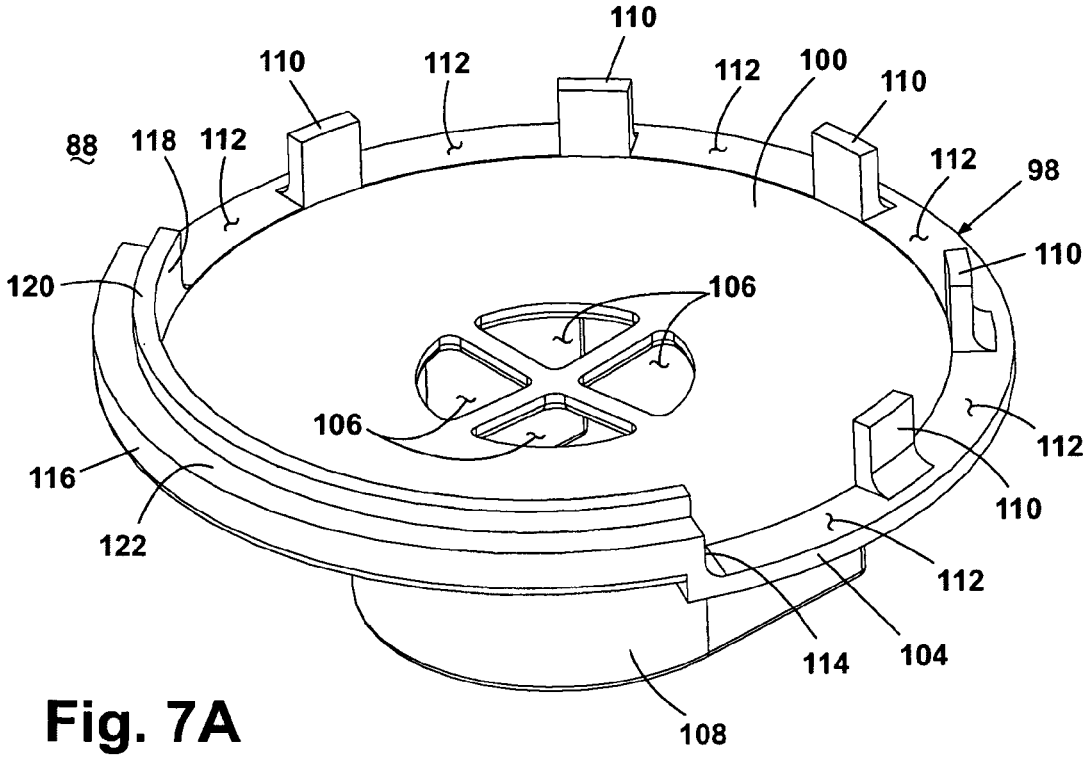
FIG. 7A is a top perspective view of a suction fan cover of the fan/turbine assembly from FIG. 2.
Figure 7B:
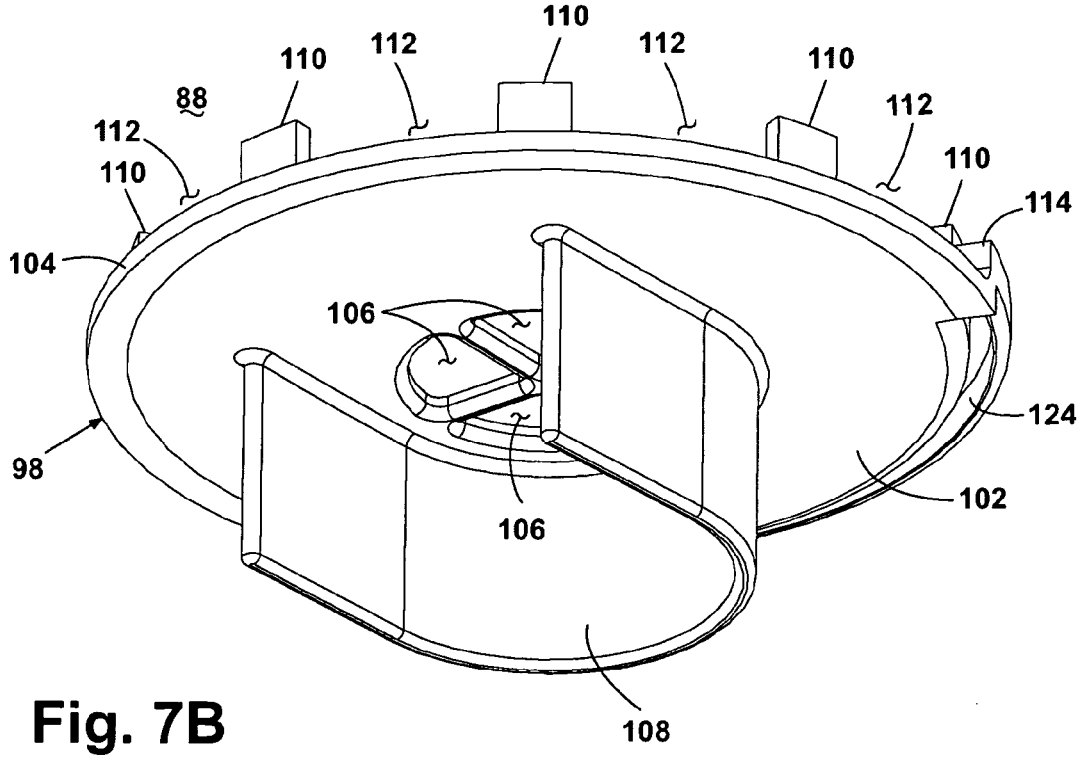
FIG. 7B is a bottom perspective view of the suction fan cover from FIG. 7A.

Referring to FIGS. 7A and 7B, the suction fan cover 88 comprises a generally flat circular body 98 having an upper surface 100, a lower surface 102, and a peripheral edge 104. At least one fan inlet opening 106 is formed in the body 98, which fluidly communicates the recovery tank 36 with the suction fan 84. As illustrated, four fan inlet openings 106 are provided. A U-shaped baffle 108 centered around the fan inlet openings 106 extends from the lower surface 102 and into the recovery chamber 46 and forms the air/liquid separator of the recovery tank 36. The baffle 108 forces air passing through the recovery tank 36 from the suction nozzle 38 to take a more circuitous path to the suction fan 84 and aids in the separation of air from recovered cleaning fluid drawn into the recovery tank 36. A plurality of spaced upstanding partitions 110 is formed on the upper surface 100 and is arranged in an arc along the periphery of one half of the body 98. The partitions 110 form fan outlets 112 therebetween that are in fluid communication with the exhaust outlets 50 when the recovery tank 34 is mounted to the fan/turbine assembly 20. Formed on the periphery of the other half of the body 98 is an upstanding arcuate wall 1 14. The wall 114 comprises an outer surface 116, which is continuous with the peripheral edge 104, an inner surface 118, and an upper surface 120. A step 122 is formed between the outer and upper surfaces 116, 120. An arcuate groove 124 is formed on the lower surface 102 and is generally aligned with the arcuate wall 114.

When the accessory tool 10 is assembled, the suction fan 84 is received within the area bounded by the partitions 110 and the arcuate wall 114 of the suction fan cover 88, and the suction fan cover 88 is received within the recovery tank 36. While not illustrated, the suction fan cover 88 can be provided with a float valve assembly for sealing the fan inlet openings 106 when the amount of fluid in the recovery chamber 46 rises above a certain level to insure that fluid does not enter the fan/turbine assembly 20. For example, the baffle 108 could be modified to include a float valve assembly. Alternately, the float valve assembly can be formed with the recovery tank assembly 18.

Figure 8A:
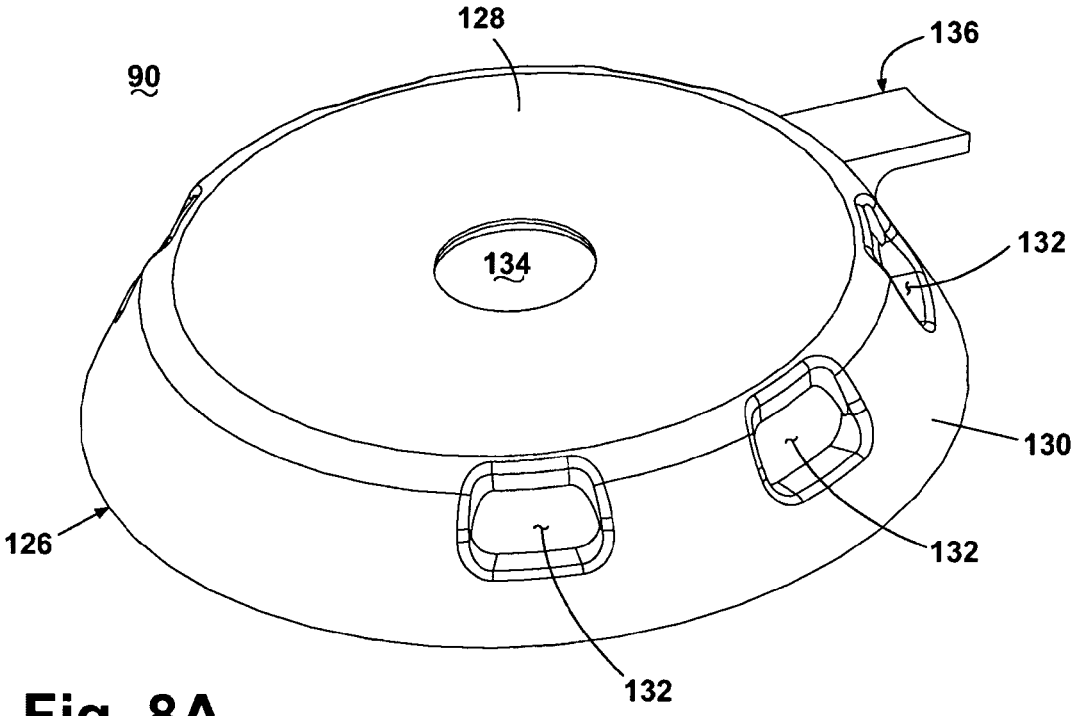
FIG. 8A is a top perspective view of a turbine cover of the fan/turbine assembly from FIG. 2.
Figure 8B:
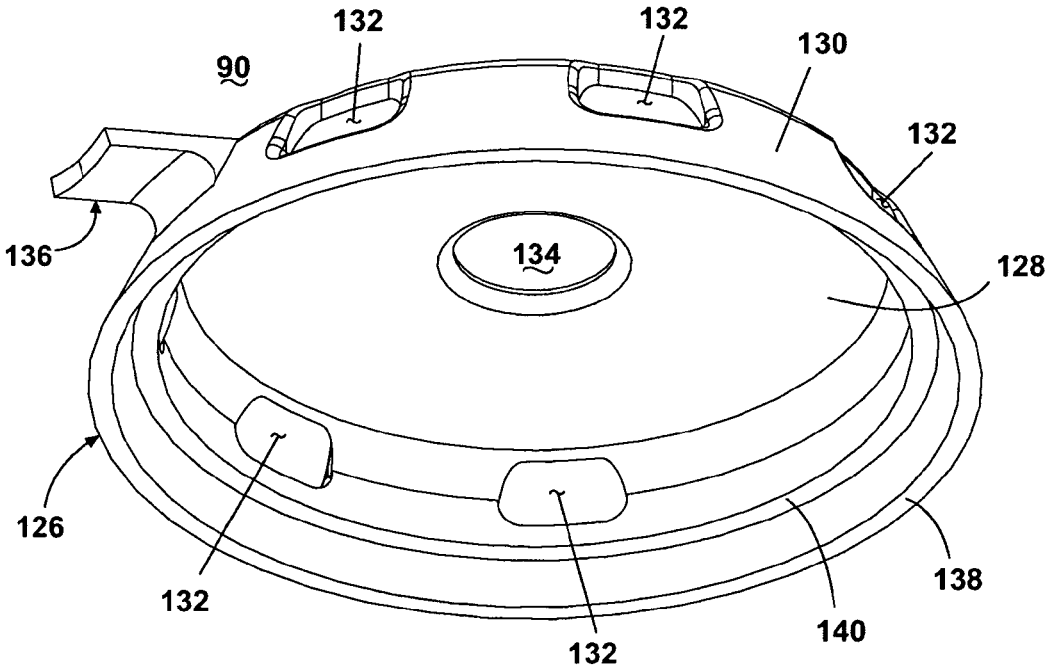
FIG. 8B is a bottom perspective view of the turbine cover from FIG. 8A.

Referring to FIGS. 8A and 8B, the turbine cover 90 comprises a dish-shaped circular body 126 having an upper wall 128 and a peripheral wall 130 depending from the upper wall 128 at an outward angle. A plurality of spaced turbine inlet openings 132 are formed in the turbine cover 90 and are preferably formed in the peripheral wall 130. At least one turbine outlet opening 134 is formed in the upper wall 128, which is generally aligned with the working air conduit inlet opening 32 of the tool body 16 and fluidly communicates the turbine 86 with the working air conduit 34. A tab 136 extends from the body 126, near the junction between the upper wall 128 and the peripheral wall 130, and is received by the tab receiver 35 on the tool body 16 to mount the turbine cover 90, which can optionally be pre-assembled with the fan/turbine assembly 20 and the recovery tank assembly 18, to the tool body 16. The peripheral wall 130 further comprises a generally planar lower surface 138 and a generally planar inner step 140, which is spaced from the lower surface 138 and formed below the turbine inlet openings 132. When the accessory tool 10 is assembled, the lower surface 138 rests atop the peripheral wall 42 of the recovery tank 36 and the inner step 140 rests atop the separation plate 92.

Figure 9A:
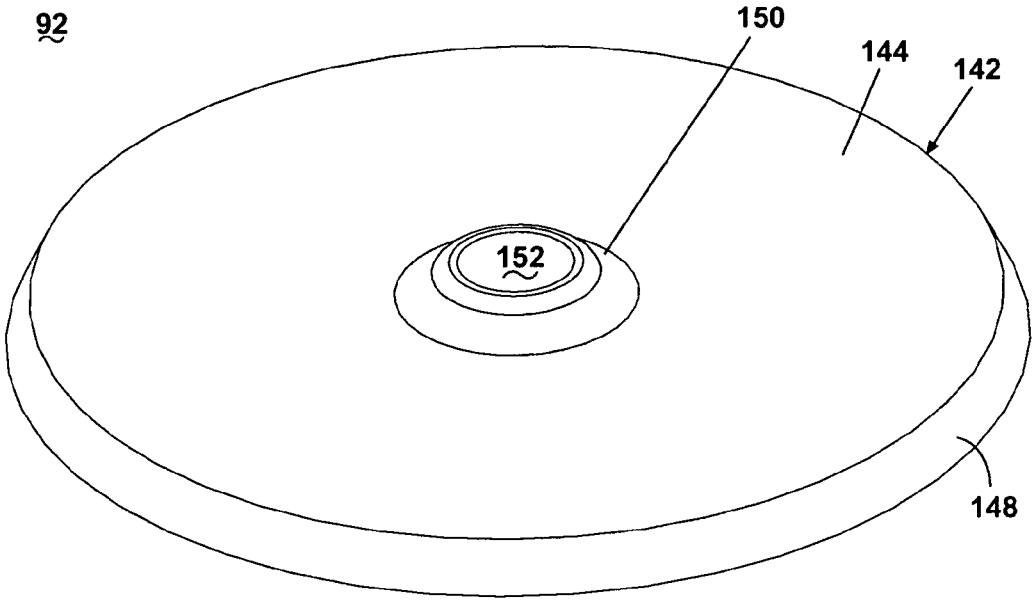
FIG. 9A is a top perspective view of a separation plate of the fan/turbine assembly from FIG. 2.
Figure 9B:
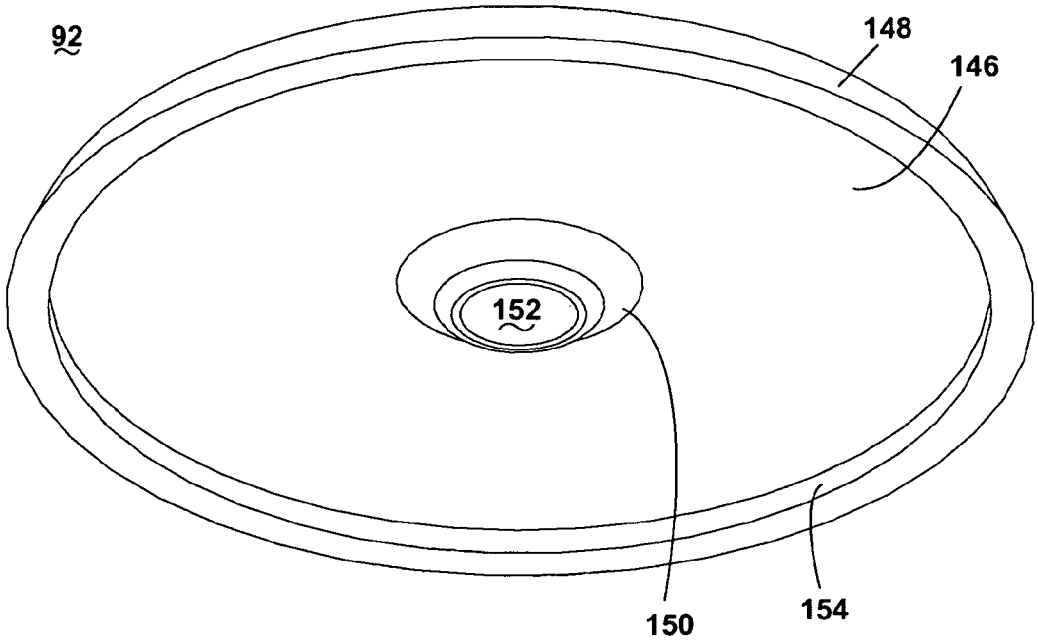
FIG. 9B is a bottom perspective view of the separation plate from FIG. 9A.

Referring to FIGS. 3, 9A and 9B, the separation plate 92 comprises a generally flat circular body 142 having an upper surface 144, a lower surface 146, and a peripheral edge 148 that angles outwardly from the upper surface 144 to the lower surface 146. A central hub 150 protrudes from the upper and lower surfaces 144, 146 and comprises a bearing opening 152 passing therethrough. The bearing 96 is received within the bearing opening 152 and in turn mounts the axel 94. A depending rim 154 is formed around the periphery of the lower surface 146 and is continuous with the peripheral edge 148. When the accessory tool 10 is assembled, the rim 154 abuts the partitions 110 and the step 122 in the arcuate wall 114 of the suction fan cover 88.

Figure 10A:
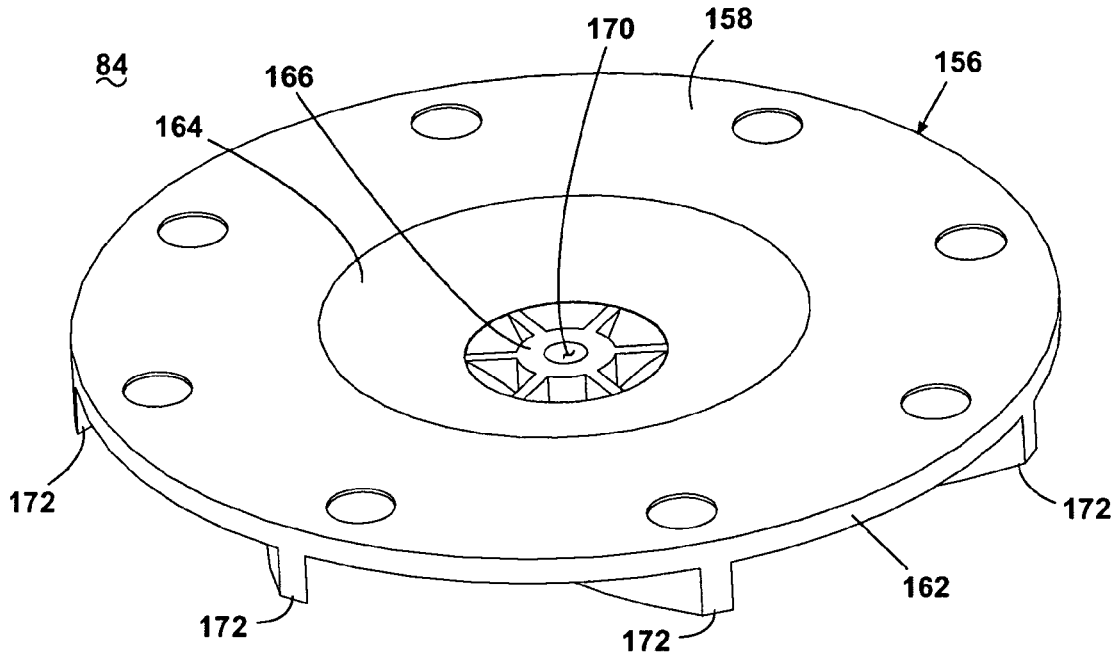
FIG. 10A is a top perspective view of a suction fan of the fan/turbine assembly from FIG. 2.
Figure 10B:
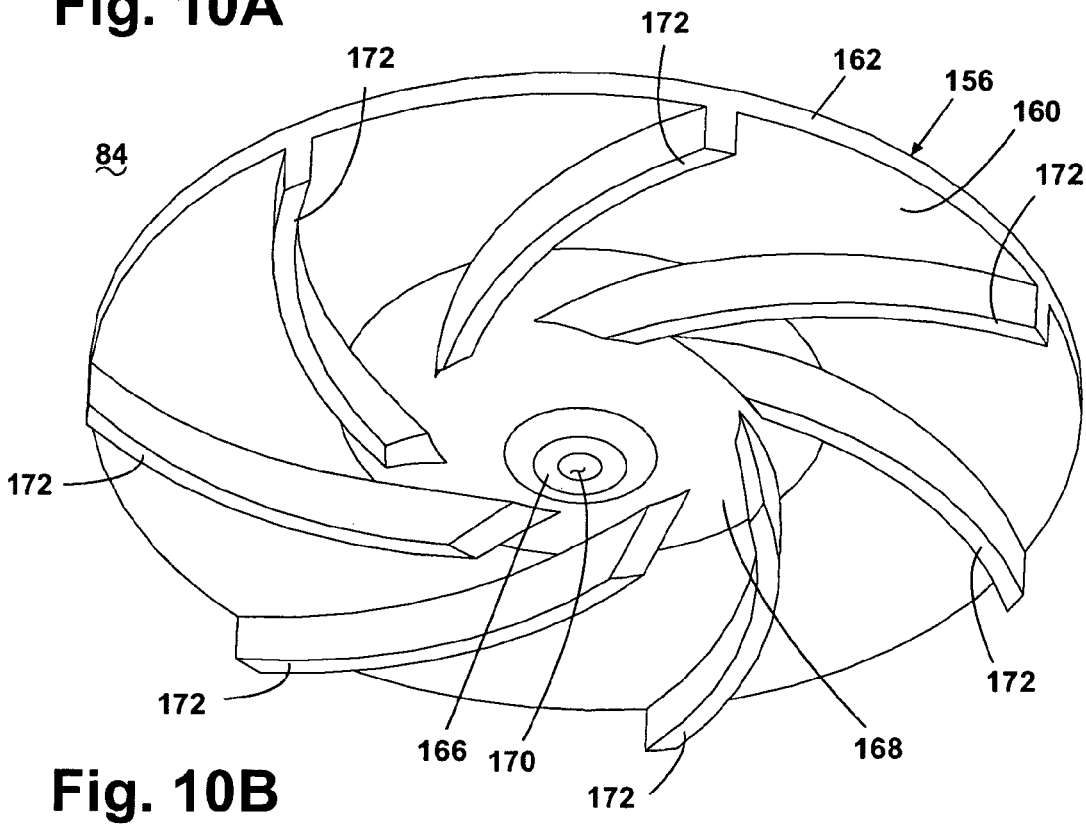
FIG. 10B is a bottom perspective view of the suction fan from FIG. 10A.

Referring to FIGS. 10A and 10B, the suction fan 84 comprises a generally circular body 156 having an upper surface 158, a lower surface 160, and a peripheral edge 162. The upper surface 158 is generally flat near the peripheral edge 162 and tapers to a central depression 164 in which a hub 166 is provided. The lower surface 160 is also generally flat near the peripheral edge 162 and tapers to a central protrusion 168 which continues the hub 166. An axle opening 170 passes through the hub 166 and receives the axle 94 to rotatably couple the suction fan 84 with the turbine 86. A plurality of arcuate fan blades 172 extend radially outwardly from the hub 166 to the peripheral edge 162 and are generally equally spaced from one another.

Figure 11A:
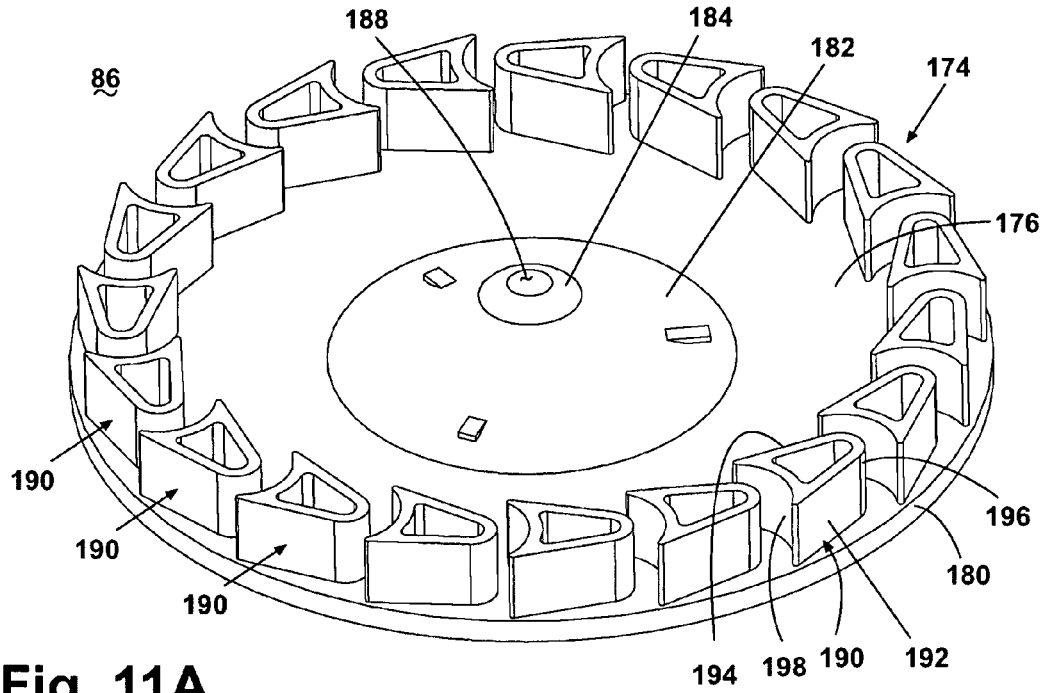
FIG. 11A is a top perspective view of a turbine of the fan/turbine assembly from FIG. 2.
Figure 11B:
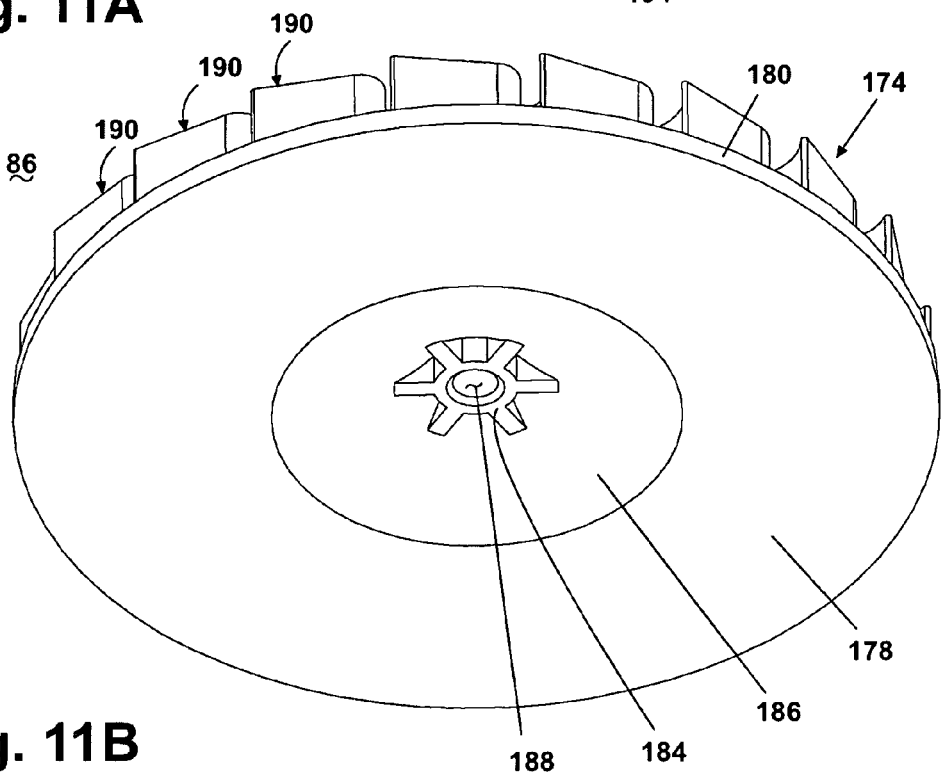
FIG. 11B is a bottom perspective view of the turbine from FIG. 11A.

Referring to FIGS. 11A and 11B, the turbine 86 comprises a generally circular body 174 having an upper surface 176, a lower surface 178, and a peripheral edge 180. The upper surface 176 is generally flat near the peripheral edge 180 and tapers to a central protrusion 182 on which a hub 184 is located. The lower surface 178 is also generally flat near the peripheral edge 180 and tapers to a central depression 186 in which the hub 184 is located. An axle opening 188 passes through the hub 184 and receives the axle 94 to rotatably couple the turbine 86 with the suction fan 84. A plurality of turbine blades 190 are provided on the upper surface 176 and are generally positioned a ring orientation near the peripheral edge 180. Each turbine blade 190 is generally triangular in shape when view from above, and comprises an outer straight segment 192 joined to a similar inner straight segment 194 by a rounded tip segment 196, with an arced segment 198 positioned opposite the rounded tip segment 194 joining the outer and inner straight segments 192, 194. As illustrated, the turbine blades 190 are hollow, which reduces the weight of the turbine 86 and saves material; however, the turbine 86 can alternately be formed with solid blades, which would increase the weight of the turbine 86 near the peripheral edge 180, thereby increasing the angular momentum of the turbine 86.

In operation, when the turbine blades 190 are exposed to a moving air stream, such as that created by the vacuum cleaner 14, the axle 94 rotates with the turbine blades 190. Specifically, the exposure of the arced segment 198 of the turbine blades 190 to a moving air stream causes the turbine body 174, and consequently the axle 94, to rotate. The rotation of the axle 94 cases the suction fan 86 to rotate. As the suction fan 84 rotates, the fan blades 172 pull air from the recovery chamber 46 through the fan openings 106, thereby creating a partial vacuum within the recovery tank 36 and suction nozzle 38 and suction at the suction nozzle opening 58.

Figure 12:
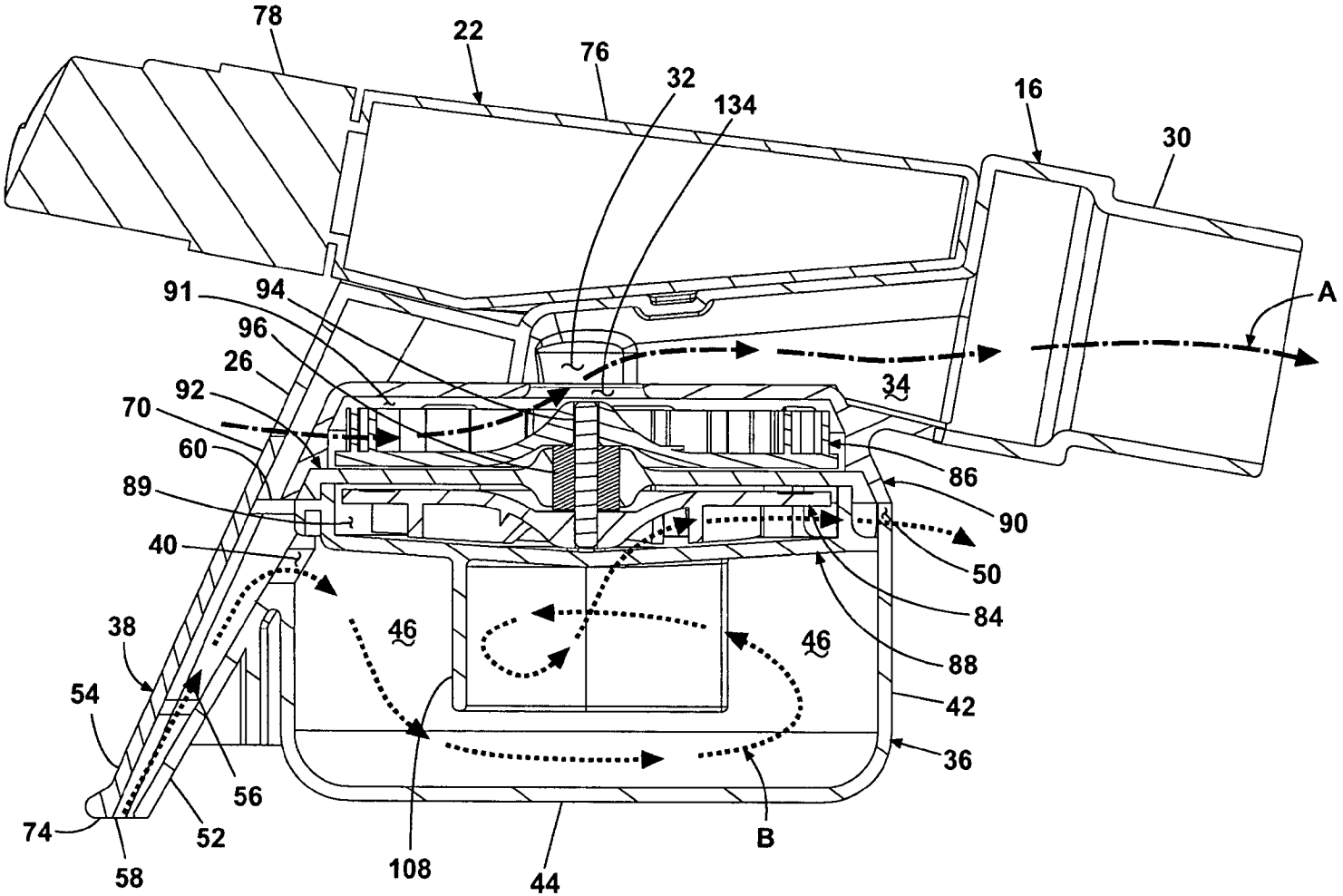
FIG. 12 is a sectional view similar to FIG. 4, illustrating the airflow pathways through the accessory tool.
Figure 13:
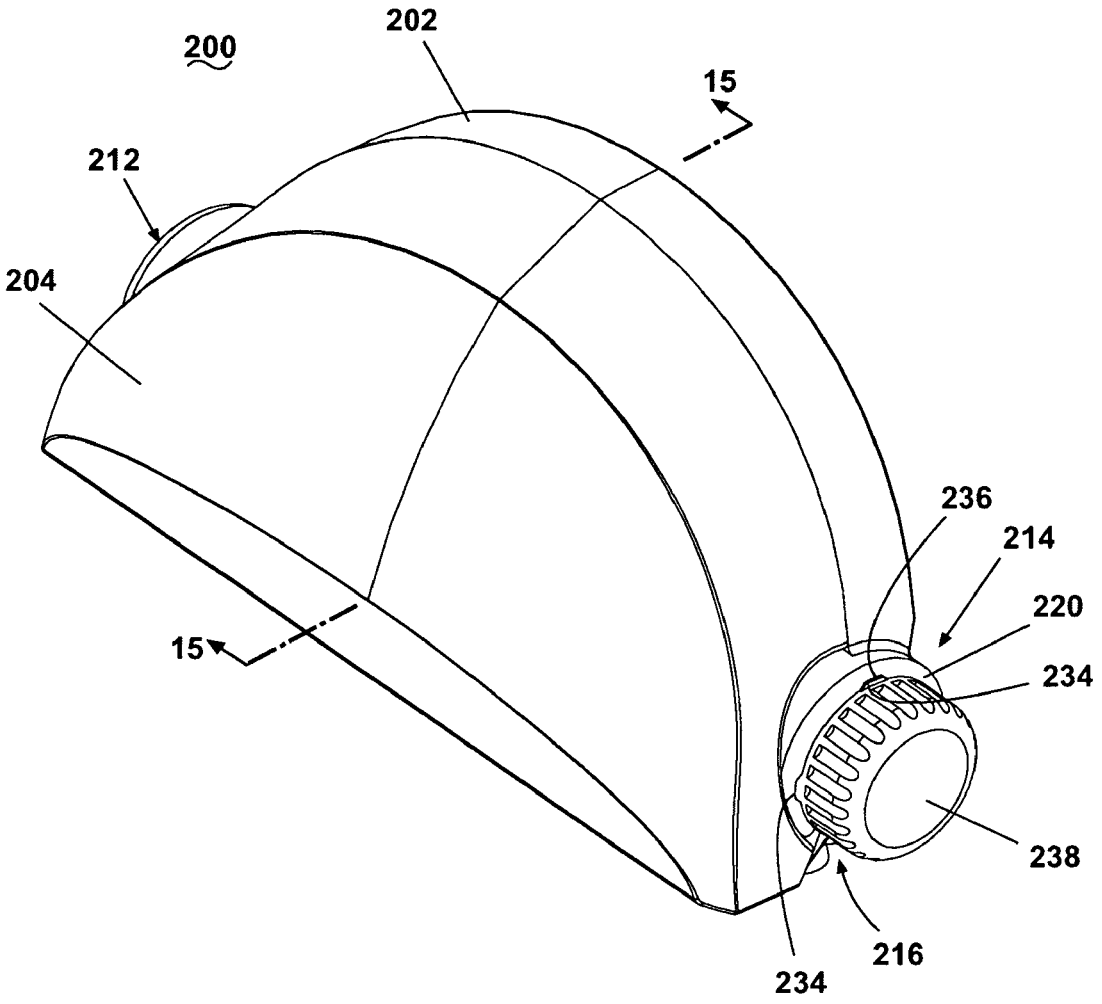
FIG. 13 is a top perspective view of a second embodiment of a nozzle assembly for the accessory tool according to the present invention, where the nozzle assembly comprises a suction nozzle and a movable agitator assembly.
Figure 14:
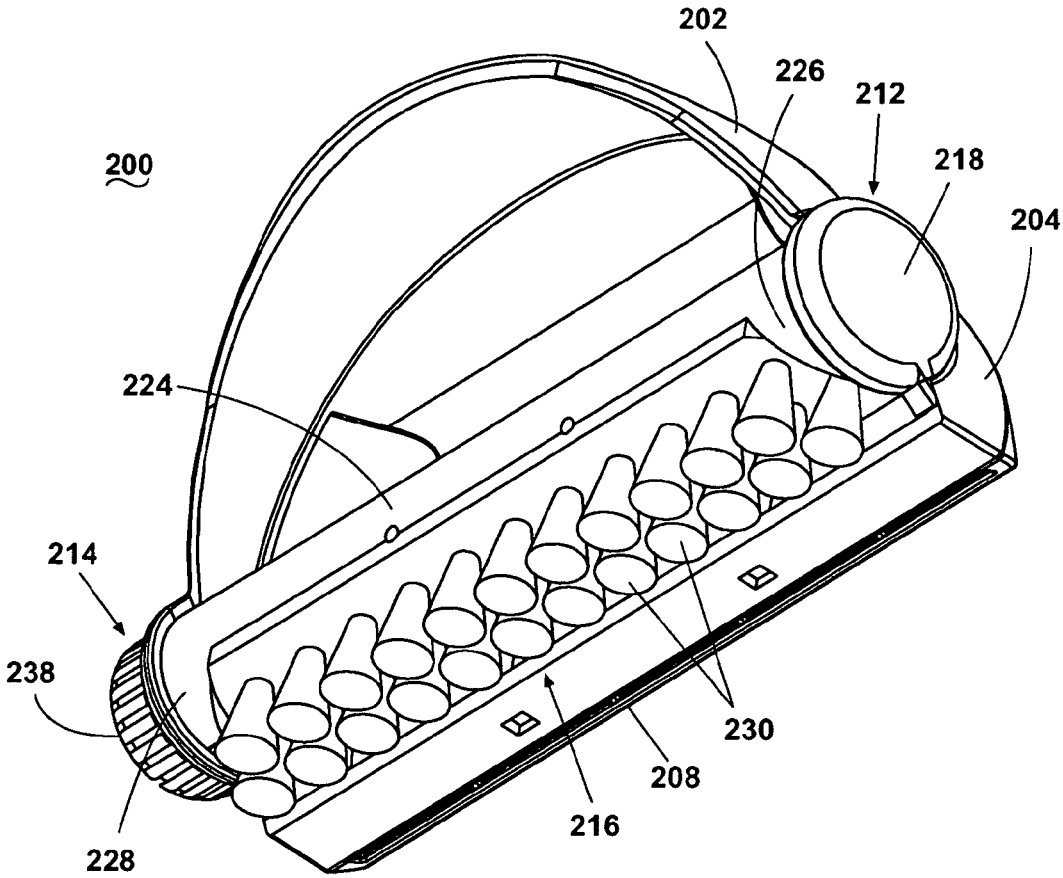
FIG. 14 is a bottom perspective view of the nozzle assembly from FIG. 13.
Figure 15:
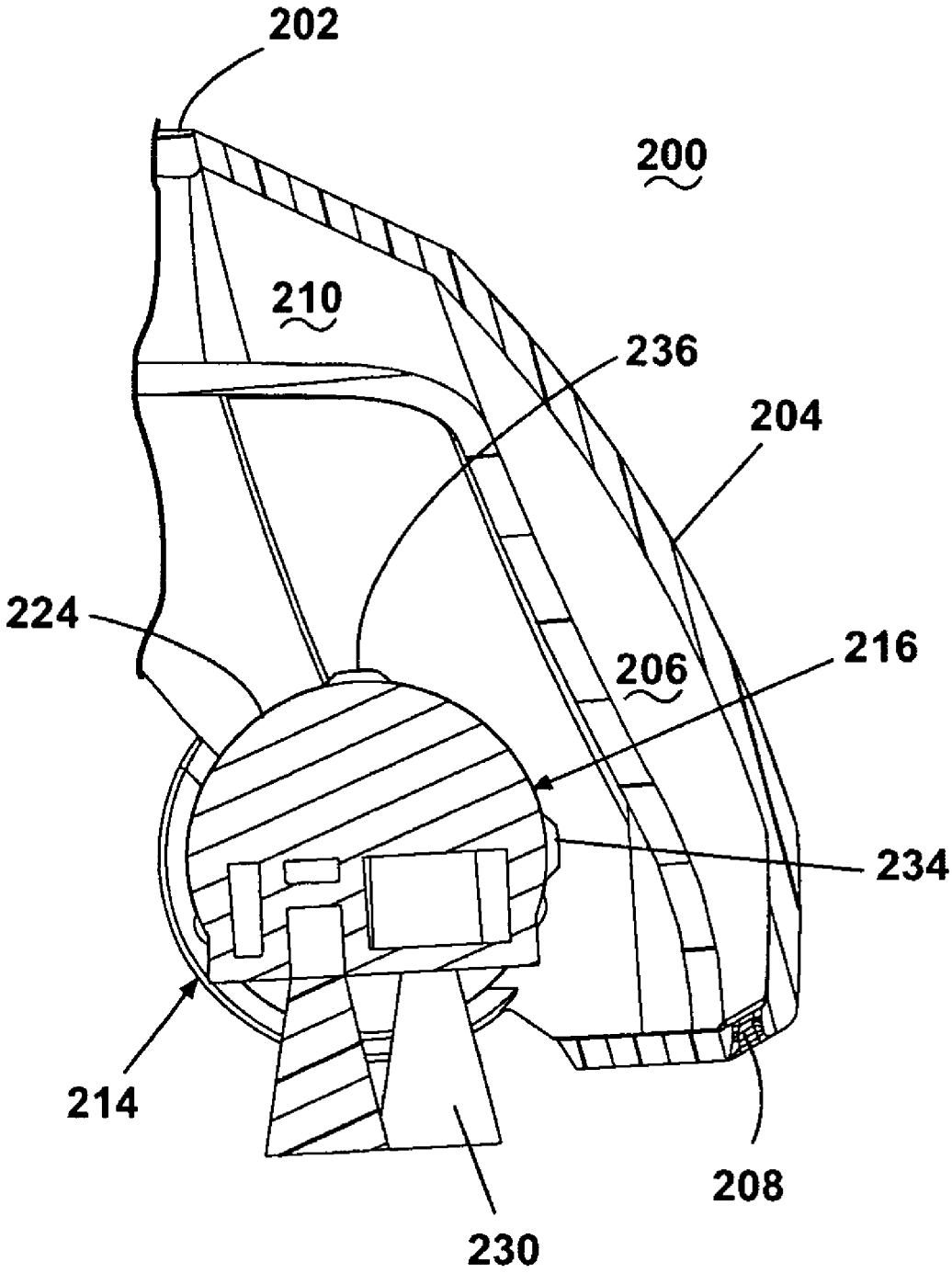
FIG. 15 is a sectional view taken through line 15-15 of FIG. 13.
Figure 16:
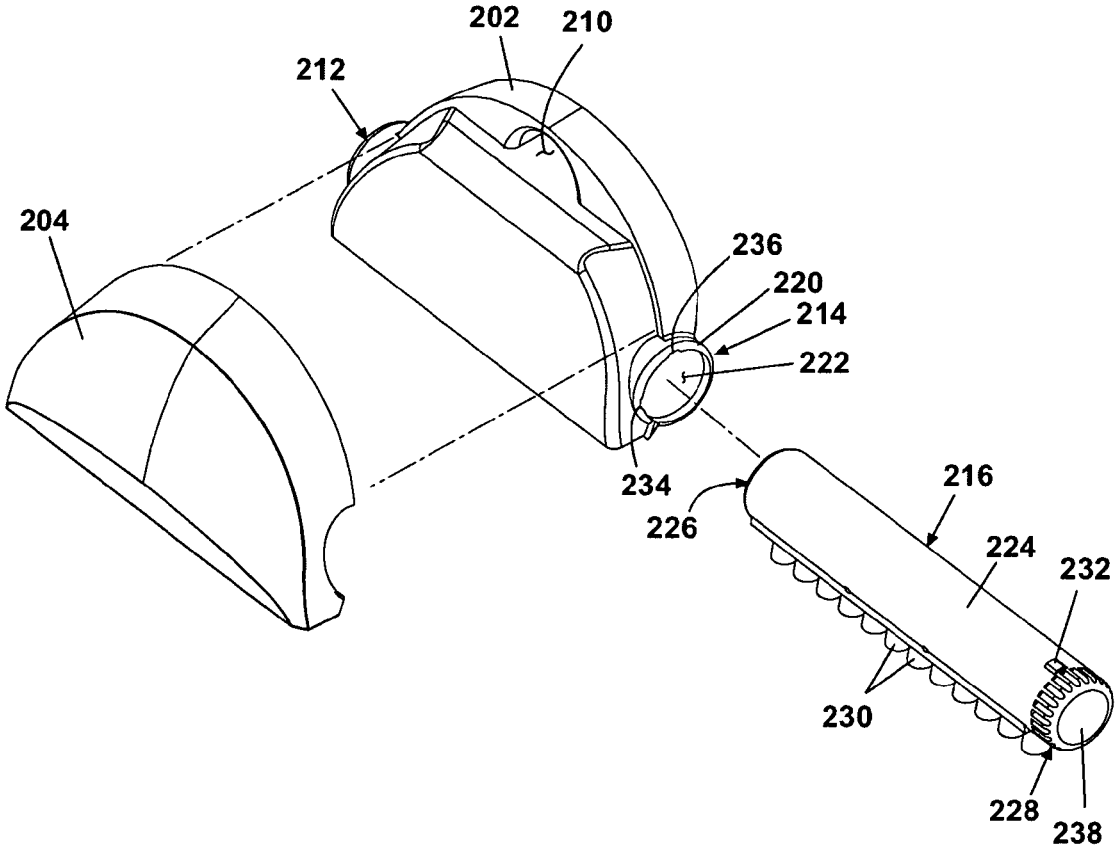
FIG. 16 is an exploded view of the nozzle assembly of FIG. 13.

Referring to FIG. 12, the airflow pathway though the accessory tool 10 is illustrated. Arrow A indicates the "dry" portion of the pathway, where air enters the turbine chamber 91 through the turbine inlet openings 132 (shown in FIG. 2) and passes through and over the turbine 86, thereby providing motive force thereto. The air then passes out of the fan/turbine assembly 20 through the turbine outlet opening 134 and into the working air conduit 34 via the working air conduit inlet opening 32. From the working air conduit 34, the air passes sequentially through the vacuum hose 12 and the vacuum cleaner 14.

Arrow B indicates the "wet" portion of the pathway, where recovered cleaning fluid and dirt enters the suction nozzle 38 and is collected in the recovery tank 36. Some air also enters the suction nozzle 38, and passes around the baffle 108 and into the suction fan chamber 89 via the fan inlet openings 106 (shown in FIG. 7A). The air then passes through and over the suction fan 84, passes out of the fan/turbine assembly 20 via the fan outlets 112, and is exhausted from the accessory tool 10 through the recovery tank air outlets 50.

Because the suction fan 84 and the turbine 86 are contained within separate chambers 89, 91, fluid from the wet portion of the pathway B is prevented from entering the vacuum cleaner 14 through the dry portion of the airflow pathway A. Furthermore, a seal (not shown) can be use at the bearing to prevent fluid from getting into the bearing 96, and potentially into the dry portion of the pathway A.

In a variation of the embodiment of the accessory tool of FIGS. 1-12, at least some of the main operating components of the accessory tool can be arranged along a generally non-vertical axis relative to the tool body, rather than a generally vertical axis. For example, at least some of the main operating components, such as the fan/turbine assembly 20, can be arranged along a generally horizontal axis. Benefits of arranging the operating components of the accessory tool along a non-vertical axis can include increased fluid capacity in the fluid dispensing assembly 22 and/or the recovery tank 36, and flexibility with regard to the overall aesthetic shape. Furthermore, the airflow pathway through the accessory tool can be reshaped to eliminate one or more 90 degree bends in either the "dry" or "wet" portion of the pathway, which can offer improved performance.

Referring to FIGS. 13-16, an alternative nozzle assembly 200 for the accessory tool according to the invention is illustration. While not specifically shown, the nozzle assembly 200 can be substituted for the suction nozzle 38 on the recovery tank assembly 18. Furthermore, the nozzle assembly 200 can be employed on other cleaning tools and apparatus. The nozzle assembly 200 comprises a rear nozzle body 202, which may or may not be integrally formed with a recovery container, such as recovery tank 36, and a front nozzle body 204 removably mounted to the rear nozzle body 202 to form a fluid flow path 206 therebetween. In another embodiment (not illustrated), the front nozzle body 204 is not removable from the rear nozzle body 202. The fluid flow path 206 extends between a suction nozzle opening 208, which, in operation, is positioned adjacent the surface to be cleaned, and an inlet 210 that fluid communicates with a recovery container, such as recovery tank 36.

A pair of agitator retainers 212, 214 is formed on either side of the rear nozzle body 202 and moveably mounts an agitator assembly 216. The first agitator retainer 212 comprises a closed end wall 218, while the second agitator retainer 214 comprises an end wall 220 having an opening 222 formed through which the agitator assembly 216 can be inserted during assembly of the nozzle assembly 200.

The agitator assembly 216 comprises a generally cylindrical agitator body 224 having a first end 226 that is mounted within the first agitator retainer 212 and a second end 228 that is mounted within the second agitator retainer 214. An agitator surface, such as bristles 230, is provided on the agitator body 224 between the first and second ends 226, 228 for scrubbing or otherwise agitating the surface to be cleaned. The bristles 230 can be sufficiently resilient so that they deform to allow the agitator assembly 216 to be inserted through the opening 222. A locking projection or detent 232 is formed on the agitator body 224 and is received in one of two spaced locking slots 234, 236 formed adjacent the opening 222 on the second agitator retainer 214. As illustrated, the first locking slot 234 is generally formed at the nine o'clock position with respect to the opening 222, and the second locking slot 236 is generally formed at the twelve o'clock position with respect to the opening 222, such that the locking slots 234, 236 are spaced roughly 90° apart. However, the locking slots 234, 236 can be positioned at many different orientations with respect to each other.

Figure 17:
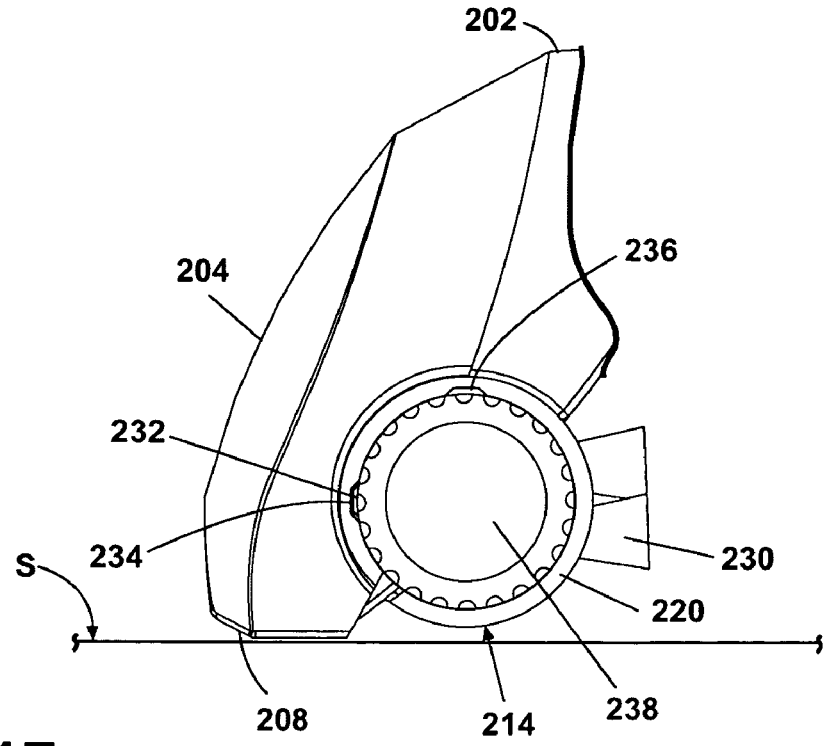
FIG. 17 is a side view of the nozzle assembly of FIG. 13, showing the nozzle assembly in a first use orientation where the suction nozzle is positioned adjacent the surface to be cleaned and the agitator assembly is rotated away from the suction to be cleaned.
Figure 18:
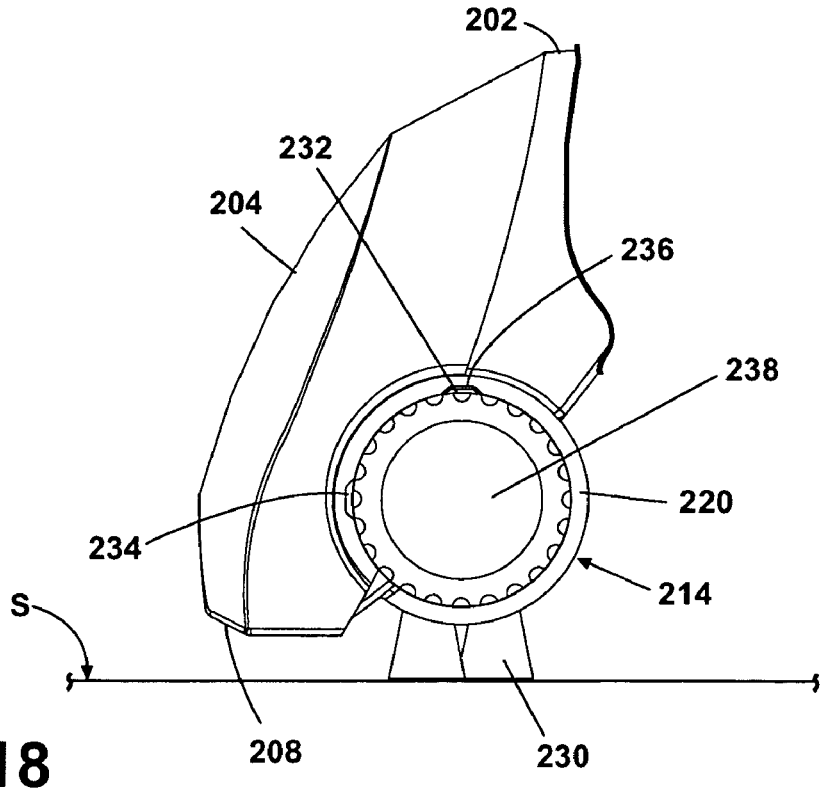
FIG. 18 is a side view of the nozzle assembly of FIG. 13, showing the nozzle assembly in a second use orientation where the suction nozzle is moved away from the surface to be cleaned and the agitator assembly is rotated to a position adjacent the surface to be cleaned.

Referring to FIG. 17, when the locking projection 232 is received within the first locking slot 234, the nozzle assembly 200 is in a first use orientation in which the suction nozzle opening 208 is positioned adjacent the surface to be cleaned S and the agitator assembly 216 is positioned with the bristles 230 spaced from the surface to be cleaned S. The first use orientation corresponds to an extraction mode of the accessory tool, in which the accessory tool can recover fluid and dirt from the surface to be cleaned S. Referring to FIG. 18, when the locking projection 232 is received within the second locking slot 236, the nozzle assembly 200 is in a second use orientation in which the suction nozzle opening 208 is moved away from the surface to be cleaned S and the agitator assembly 216 is positioned with the bristles 230 adjacent the surface to be cleaned S. The second use orientation corresponds to a scrubbing mode of the accessory tool, where the accessory tool can agitate the surface to be cleaned S after the application of cleaning solution. A knob 238 for moving the agitator assembly 216 between the first and second use orientations is provided on the second end 228 of the agitator body 224 and projects exteriorly of the second agitator retainer 214 to be easily accessible to the user for manual actuation.

To move the agitator assembly 216 from the first to the second use orientation, the agitator body 224 is rotated, preferably using the knob 238, in a clockwise direction with respect to the orientation of FIGS. 17 and 18 so that the locking projection 232 emerges from the first locking slot 234 and is recaptured in the second locking slot 236. This requires a roughly 90° rotation as illustrated. A similar method is used to move the agitator assembly 216 back to the first use orientation.

The rotatable agitator assembly 215 separates the extraction mode from the scrubbing mode. The position of the bristles 230 in scrubbing mode (FIG. 18) spaces the suction nozzle opening 208 from the surface to be cleaned to keep fluid from being extracted before it is agitated.

The accessory tool according to any of the above embodiments expands the cleaning capability of a conventional dry floor surface cleaning appliance to distribute cleaning fluid as well as recover fluid. The accessory tool can also be used with a wet extraction cleaning appliance for both distributing and recovering fluid. The accessory tool is designed such that the water recovery path is separated and isolated from the conventional working air path of the vacuum cleaning appliance to prevent water laden working air from entering the vacuum cleaning appliance. Other embodiments of the accessory tool not specifically shown herein are possible. For example, the accessory tool can include an agitating surface, such as a scrubbing pad or a brush. The agitating surface can further be configured for movement, and can be coupled with the turbine to provide motive power thereto.

While the invention has been specifically described in connection with certain specific embodiments thereof, it is to be understood that this is by way of illustration and not of limitation, and the scope of the appended claims should be construed as broadly as the prior art will permit. For example, while the figures describe a device with the main operating components arranged along a generally vertical axis relative to the tool body, it is understood that the components can be arranged along a generally horizontal axis or at any angle therebetween.

What is claimed is:

1. A hand held surface cleaning implement, comprising:

a nozzle assembly having front nozzle body with a suction nozzle, a rear nozzle body and a hose connector that is adapted to be connected to a vacuum hose as a source of suction, wherein a fluid flow path is formed between the suction nozzle and the rear nozzle body, and the suction nozzle is adapted to remove fluid from a surface to be cleaned when the suction nozzle is in contact with the surface to be cleaned with the front nozzle body in a predetermined orientation with respect to the surface to be cleaned and suction is applied to the fluid flow path;

an agitator assembly comprising an agitator body mounted to the front nozzle body and an agitator member immovably mounted to the agitator body for scrubbing or otherwise agitating the surface to be cleaned;

wherein the agitator body is mounted to the front nozzle body for movement between a first position and a second position; and wherein the suction nozzle and the agitator body are configured within the front nozzle body so that when the front nozzle body is in the predetermined orientation with respect to the surface to be cleaned and the agitator body is in the first position, the suction nozzle is spaced from the surface to be cleaned by the agitator member, and when the front nozzle body is in the predetermined orientation with respect to the surface to be cleaned and the agitator body is in the second position, the suction nozzle is in contact with the surface to be cleaned.

2. The surface cleaning implement according to claim 1 and further comprising a recovery tank mounted to the rear nozzle body and in fluid communication with the suction nozzle.

3. The surface cleaning implement according to claim 2 and further comprising a suction fan rotatably mounted within a suction fan chamber having an inlet opening in fluid communication with the suction nozzle through the recovery tank for depositing fluid that is drawn in through the suction nozzle into the recovery tank and an outlet opening in fluid communication with the atmosphere.

4. The surface cleaning implement according to claim 1 wherein the agitator body is mounted in a pair of agitator retainers formed on opposite sides of the front nozzle body for movement between the first and second positions.

5. The surface cleaning implement according to claim 1 wherein the agitator member comprises at least one row of bristles.

6. The surface cleaning implement according to claim 5 wherein a locking projection or detent is formed on one of the agitator body and the front nozzle body and a pair of spaced locking slots are formed in the other of the agitator body and front nozzle body for releasably retaining the agitator body in the in the first and second positions.

7. The surface cleaning implement according to claim 6 wherein the spaced locking slots are spaced about 90° apart.

8. The surface cleaning implement according to claim 1 wherein the agitator member comprises bristles that extend below the suction nozzle when the agitator body is in the first position.

9. The surface cleaning implement according to claim 1 wherein the agitator body is elongated, supports the agitator member and defines an axis about which the agitator body is movable.

10. The surface cleaning implement according to claim 9 wherein the agitator assembly comprises a knob positioned on one end of the elongated agitator body for moving the agitator body between the first and second positions.

11. The surface cleaning implement according to claim 10 wherein at least a portion of the knob projects exteriorly of the front nozzle body.

12. The surface cleaning implement according to claim 1 and further comprising a knob for moving the agitator body between the first and second positions, wherein at least a portion of the knob projects exteriorly of the front nozzle body.

13. The surface cleaning implement according to claim 1 and further comprising a detent mechanism between the agitator body and the front nozzle body and configured to releasably retain the agitator body in the first and second positions.

14. A surface cleaning implement, comprising:

a housing having a suction nozzle; and an agitator assembly comprising an agitator member for scrubbing or otherwise agitating the surface to be cleaned;

wherein the agitator assembly is rotatably mounted to the housing for movement between a first position in which the agitator member is in contact with a surface to be cleaned and a second position in which agitator member is rotated away from the surface to be cleaned;

wherein the suction nozzle and the agitator assembly are configured within the housing so that the suction nozzle is spaced from the surface to be cleaned when the agitator assembly is in the first position and the suction nozzle is in contact with the surface to be cleaned when the agitator assembly is in the second position;

a recovery tank mounted on the housing and in fluid communication with the suction nozzle;

a suction fan rotatably mounted within a suction fan chamber having an inlet opening in fluid communication with the suction nozzle through the recovery tank for depositing fluid that is drawn in through the suction nozzle into the recovery tank and an outlet opening in fluid communication with the atmosphere a turbine rotatably mounted within a turbine chamber having an inlet opening in fluid communication with the atmosphere and an outlet opening connected to a suction opening in the housing for rotatably driving the turbine with suction from the suction source; and a coupling between the turbine and the suction fan, whereby the turbine drives the suction fan when suction is applied at the suction opening.

15. A surface cleaning implement, comprising:

a housing having a suction nozzle adapted to be connected to a source of suction; and an agitator assembly comprising an agitator member for scrubbing or otherwise agitating the surface to be cleaned;

wherein the agitator assembly is rotatably mounted to the housing for movement between a first position in which the agitator member is in contact with a surface to be cleaned and a second position in which agitator member is rotated away from the surface to be cleaned; and wherein the suction nozzle and the agitator assembly are configured within the housing so that the suction nozzle is spaced from the surface to be cleaned when the agitator assembly is in the first position and the suction nozzle is in contact with the surface to be cleaned when the agitator assembly is in the second position;

wherein the agitator assembly is movably mounted in a pair of agitator retainers formed on opposite sides of the housing for movement between the first and second positions; and wherein the agitator assembly comprises an elongated agitator body and the agitator member has at least one row of bristles extending along the body for scrubbing or otherwise agitating the surface to be cleaned; and a locking projection or detent is formed on one of the agitator body and the agitator retainers and a pair of spaced locking slots are formed in the other of the agitator body and agitator retainers for alternately receiving the projection or detent to releasably retain the agitator assembly in the first and second positions.

16. A surface cleaning implement, comprising:

a housing having a suction nozzle adapted to be connected to a source of suction; and an agitator assembly comprising an agitator member for scrubbing or otherwise agitating the surface to be cleaned;

wherein the agitator assembly is rotatably mounted to the housing for movement between a first position in which the agitator member is in contact with a surface to be cleaned and a second position in which agitator member is rotated away from the surface to be cleaned; and wherein the suction nozzle and the agitator assembly are configured within the housing so that the suction nozzle is spaced from the surface to be cleaned when the agitator assembly is in the first position and the suction nozzle is in contact with the surface to be cleaned when the agitator assembly is in the second position;

wherein the agitator assembly comprises an elongated agitator body which supports the agitator member and defines an axis about which the agitator assembly is rotated;

wherein the agitator assembly comprises a grip positioned on one end of the elongated agitator body for moving the agitator assembly between the first and second positions and at least a portion of the grip projects exteriorly of the housing.

17. The surface cleaning implement according to claim 3 and further comprising a turbine rotatably mounted within a turbine chamber having an turbine inlet opening in fluid communication with the atmosphere and an turbine outlet opening connected to a second suction source for rotatably driving the turbine with suction from the second suction source; and further comprising a coupling between the turbine and the suction fan, whereby the turbine drives the suction fan when suction is applied at the turbine outlet opening.

18. The surface cleaning implement according to claim 14 and further comprising a fluid dispensing assembly mounted to the housing for distributing cleaning fluid onto a surface to be cleaned.

19. The surface cleaning implement according to claim 14 wherein the recovery tank comprises an air/liquid separator for separating air from liquid drawn into the recovery tank through the suction nozzle.

* * * * *